US006227811B1

(12) United States Patent
Ahn

(10) Patent No.: US 6,227,811 B1
(45) Date of Patent: May 8, 2001

(54) VARIABLE CAPACITY SWASH PLATE TYPE COMPRESSOR

(75) Inventor: Hewnam Ahn, KyongNam (KR)

(73) Assignees: Visteon Global Technologies, Inc., Dearborn, MI (US); Halla Climate Control Corp., Taejon (KR)

( * ) Notice: Subject to any disclaimer, the term of this patent is extended or adjusted under 35 U.S.C. 154(b) by 0 days.

(21) Appl. No.: 09/414,197

(22) Filed: Oct. 7, 1999

(30) Foreign Application Priority Data

Oct. 11, 1998 (KR) ..... 98-48043

(51) Int. Cl.[7] ..... F04B 1/26; F04B 1/12
(52) U.S. Cl. ..... 417/222.1; 417/269
(58) Field of Search ..... 417/222.1, 222.2, 417/269; 92/12.2, 71; 91/499

(56) References Cited

U.S. PATENT DOCUMENTS

| | | | | |
|---|---|---|---|---|
| 5,336,056 | * | 8/1994 | Kimura et al. | 417/222.1 |
| 5,382,139 | * | 1/1995 | Kawaguchi et al. | 417/269 |
| 5,387,091 | * | 2/1995 | Kawaguchi et al. | 417/222.2 |
| 5,540,559 | * | 7/1996 | Kimura et al. | 417/222.2 |
| 5,644,968 | * | 7/1997 | Kimura et al. | 92/12.2 |
| 5,897,298 | * | 4/1999 | Umemura | 417/222.2 |

* cited by examiner

*Primary Examiner*—Timothy S. Thorpe
*Assistant Examiner*—Michael K. Gray
(74) *Attorney, Agent, or Firm*—Larry I. Shelton

(57) ABSTRACT

A variable capacity swash plate type compressor 10 incorporates a swash plate 34 to effect movement of at least an associated piston 44 to vary the capacity of the compressor 10. The structure of the swash plate 34 and piston 44 minimize the bending moment exerted on the piston 44 during operation.

5 Claims, 3 Drawing Sheets

VARIABLE CAPACITY SWASH PLATE TYPE COMPRESSOR

BACKGROUND OF THE INVENTION

The present invention relates to a variable capacity swash plate type compressor adapted for use in an air conditioner for a vehicle, and more particularly, to a piston suitable for use in an automotive air conditioning compressor in which the piston includes an associated swash plate to minimize the bending moment exerted thereon.

Generally, a piston type compressor for use in an automotive air conditioning system comprises a cylinder block having a plurality of cylinder bores. A plurality of pistons are slidably disposed in the respective cylinder bores and reciprocate by, for example, a swash plate in the cylinder bores. In a variable capacity swash plate type compressor with a mechanism varying an inclination angle of the swash plate, a single-headed piston is generally used. The single-headed piston includes a body with a head, and support portion for receiving shoes which convert rotation of the swash plate into reciprocation of the pistons. However, a bending moment acts on the pistons due to force exerted deflectively on the pistons during operation of the compressor. Accordingly, the bending moment causes the deformation of pistons, and thus, a contact portion between the pistons and the cylinder bores is abraded deflectively.

SUMMARY OF THE INVENTION

It is an object of the invention to provide a swash plate type compressor with pistons by which the problems of the prior art can be solved.

Another object of the invention is to provide a swash plate type compressor provided with a piston having a construction to minimize a bending moment by which high durability of the piston and compressor can be accomplished.

Still another object of the invention is to provide a swash plate type compressor provided with a mechanism suitable for a piston having a construction to minimize a bending moment.

The above as well as other objects of the invention may be typically achieved by producing a variable capacity swash plate type compressor comprising:

- a cylinder block having a plurality of cylinder bores arranged radially and circumferentially therein;
- a housing mounted adjacent the cylinder block and cooperating with the cylinder block to define an air-tight sealed crank chamber;
- a drive shaft rotatably supported by the housing and the cylinder block;
- a rotor mounted on the drive shaft;
- a swash plate connected to the rotor and slidably mounted on the drive shaft to thereby change an inclination angle thereof in response to the changes of pressure in the crank chamber;
- a hinge means disposed between the rotor and the swash plate for changing the inclination angle of the swash plate;
- a plurality of pistons reciprocatively disposed in each of the cylinder bores, each piston having a cylindrical body with a head, and a bridge portion connected to the body and having a recess and a pair of shoe pockets formed in opposed walls defining the recess, the body of each piston having a lower back edge portion extending to a place between an entrance and an apex of the shoe pocket adjacent to the body, the lower back edge portion being around a portion connected to the bridge portion, whereby contact between the swash plate and the lower back edge portion of the pistons is prevented;
- a plurality of shoes disposed in the shoe pockets of the recess of each piston to come into contact with the swash plate for converting rotation of the swash plate into reciprocation of the pistons; and
- a control valve means for adjusting a pressure level in the crank chamber.

BRIEF DESCRIPTION OF THE DRAWINGS

Other objects, features, and advantages of the present invention will be understood from the detailed description of the preferred embodiments of the present invention with reference to the accompanying drawings, in which.

DETAILED DESCRIPTION OF THE PREFERRED EMBODIMENTS

Figure 1:
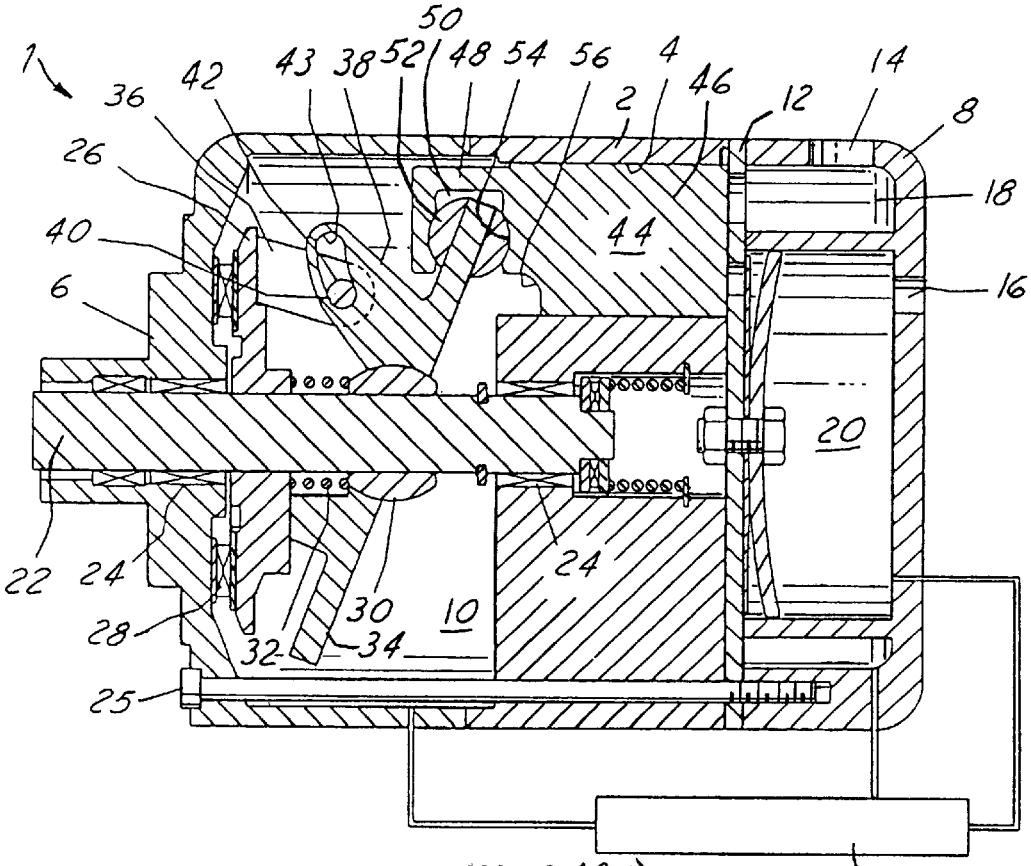
(PRIOR ART) FIG. 1
FIG. 1 is a sectional elevational view of a swash plate type compressor with a variable displacement mechanism according to the prior art.

In order to clarify the problems occurring in a conventional swash plate type compressor with a variable displacement mechanism, description will be made with reference to FIG. 1. The compressor 1 of this type has a cylinder block 2 with a plurality of cylinder bores 4, and front and rear ends of the cylinder block 2 are sealingly closed by front and rear housings 6 and 8. The cylinder block 2 and the front housing 6 define an airtight sealed crank chamber 10. A valve plate 12 is intervened between the rear end of the cylinder block 2 and the rear housing 8. The rear housing has formed therein inlet and outlet ports 14 and 16 for input and output of a refrigerant gas, a suction chamber 18, and a discharge chamber 20. The suction and discharge chambers 18 and 20 are communicated with the respective cylinder bores 4 via suction and discharge valve mechanisms. A drive shaft 22 is centrally arranged to extend through the front housing 6 to the cylinder block 2 and rotatably supported by bearings 24 mounted in the front housing 6 and the cylinder block 2. The cylinder block 2 and the front and rear housings 6 and 8 are combined by a long screw 25. A rotor 26 is mounted on the drive shaft 22 in the crank chamber 10 to be rotatable with the drive shaft 22, and supported by a thrust bearing 28 seated on an inner end of the front housing 6. A spherical sleeve 30 having an outer spherical surface formed as a support surface is slidably supported by the drive shaft 22. A spring 32 mounted around the drive shaft 22 is interposed between the rotor 26 and the spherical sleeve 30, and pushes the spherical sleeve 30 toward the rear housing 8.

A swash plate 34 is rotatably supported on the outer surface of the spherical sleeve 30. The swash plate 34 is connected to the rotor 26 via a hinge mechanism so as to be rotated with the rotor 26. Namely, a support arm 36 protrudes axially outwardly from one side surface of the rotor 26, and an arm 38 protrudes from one side surface of the swash plate 34 toward the support arm 36 of the rotor 26. The support arm 36 and the arm 38 overlap each other and are connected to each other by a pin 40. The pin 40 extends into a pin hole 42 formed through the support arm 36 of the rotor 26 and a rectangular shaped hole 43 formed through the arm 38 of the swash plate 34. In this manner, the rotor 26 and the swash plate 34 are hinged to each other, and the sliding motion of the pin 40 within the rectangular hole 43 changes an inclination angle of the swash plate 34 so as to change the capacity of the compressor.

Pistons 44 are slidably disposed in the respective cylinder bores 4. Each piston 44 has a body 46 with a head portion which is slidably disposed in the corresponding cylinder bore 4, and a bridge portion 48 which has formed therein a recess 50. Semi-spherical shoes 52 are disposed in shoe pockets 54 formed in the bridge portion of the piston 44 and slidably engaged with a peripheral portion of the swash plate 34. Therefore, the swash plate 34 is rotated together with the rotation of the drive shaft 22, and the rotation of the swash plate 34 is converted into the reciprocation of the pistons 44.

A cutout portion 56 is formed at a lower left end portion of the piston 44 to prevent a contact between a side surface of the swash plate 34 and the body 46 of the piston 44 when a piston 44 is in its bottom dead center.

A control valve means 60 is provided with the compressor to adjust a pressure level in the crank chamber 10.

In the above-described type of compressor, a bending moment among various forces acting on the pistons 44 causes a deformation of the pistons 44 and a partially deflected abnormal abrasion about a contact portion between the pistons 44 and the cylinder bores 4.

Figure 2:
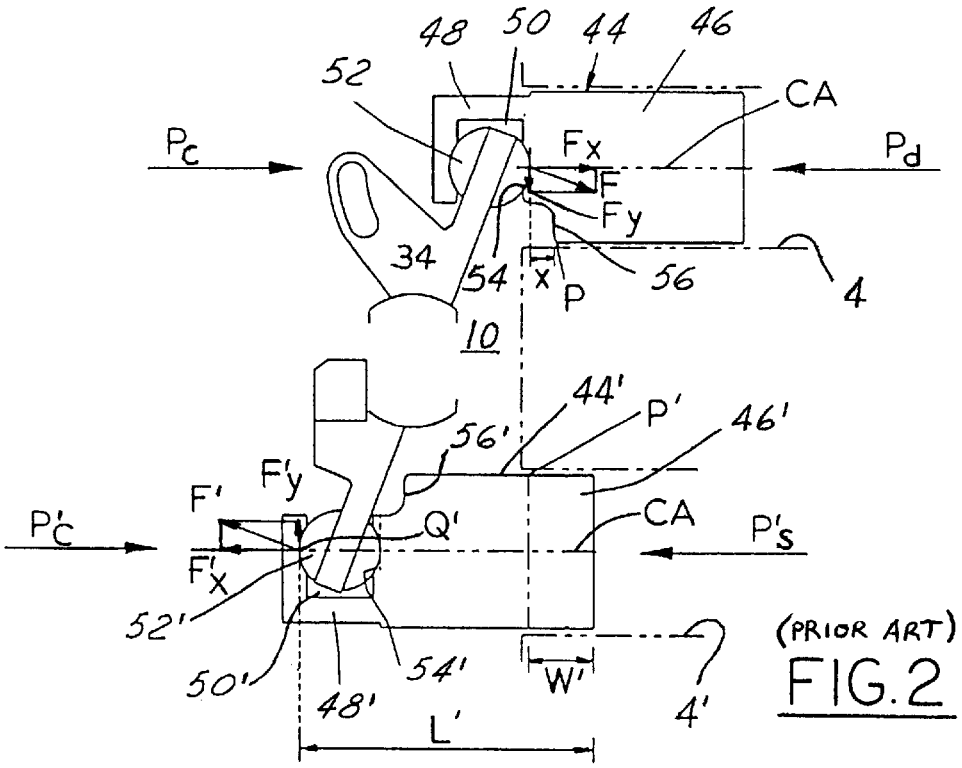
(PRIOR ART) FIG. 2
FIG. 2 is a fragmentary schematic view of FIG. 1 illustrating various forces acting on a piston.

FIG. 2 is an enlarged partial view of FIG. 1 to illustrate various forces acting on the pistons. Referring to FIG. 2, during the compression stroke of the piston 44, the pressure PC in the crank chamber 10 acts on one end of the piston 44 while a compression reaction force Pd acts on the other end of the piston 44. The pressure PC in the crank chamber 10 and the compression reaction force Pd act on the swash plate from the piston via the shoes 52, and the action force exerted on the swash plate 34 reversely acts on the piston 44 via the shoes 52 as a reaction force which is equal in magnitude and oppositely directed to the action force. That is, when the piston 44 is in its compression stroke, the force F exerted from the swash plate 34 on the piston 44 acts on the piston 44 at an angle perpendicular to surfaces of the swash plate 34 at a contact position at which the semi-spherical outer surface of the shoe 52 adjacent to the body of the piston 44 comes into contact with the semi-spherical inner surface of the shoe pocket 54, i.e., at an apex of the shoe pocket 54 lying on the central axis CA of the piston 44. The force F exerted from the swash plate 34 on the piston 44 is composed of two components, horizontal and vertical components, the horizontal component $F_x$ lying on the central axis CA of the piston 44 and the vertical component $F_y$ being perpendicular to the central axis CA of the piston 44. Let "m" be the mass of the piston 44, "a" be the acceleration of the piston 44 during the compression stroke, "A" be the cross sectional area of the piston 44, "θ" be the angle from horizontal the force F is acting on the piston 44, and "d" be the diameter of the piston 44.

$$\Sigma F_x = ma \tag{1}$$

$$\Sigma F_x AP_c - AP_d + F_x \tag{2}$$

By combining the above equations, we can write, $$F_x = ma + A(P_d - P_c) = ma + (\pi/4)^* d^2 (P_d - P_c)$$

and $$F_y = F_x \tan\theta = \tan\theta \square ma + (\pi/4)^* d^2 (P_d - P_c) \square$$

The vertical component $F_y$ acts on the piston 44 as a bending moment which is maximized at the lower back edge designated by "P". Each piston 44 is provided with the cutout portion 56 to prevent a piston 44 from coming into contact with one side surface (front surface) of the swash plate 34 when a piston 44 approaches its bottom dead center during the suction stroke. The cutout portion 56 provides a distance x between an operating point of the force F acting on the piston and an operating point of a reaction force acting on the cutout portion 56, i.e., the lower back edge of the piston 44, as shown in FIG. 2, and the distance x causes a bending moment which acts on the piston 44. The maximum bending moment $M_{max}$ acting on the piston is given by $$M_{max} x\ F_y x \tan\theta \square ma + (\pi/4)^* d^2 (P_d - P_c) \square \tag{3}$$

Therefore, due to the bending moment, the piston 44 is deformed by the distance x about the bridge portion 48 of the piston 44 in a counterclockwise direction with respect to the reaction force-operating point P, and at the same time, deflected abnormal abrasion also occurs in the body of the piston about the reaction force-operating point P and in an edge portion diagonally opposed thereto.

On the other hand, during the suction stroke of the piston 44', the pressure $P_c'$ in the crank chamber 10' acts on one end of the piston 44' while a suction force $P_s'$ acts on the other end of the piston 44'. The pressure $P_c'$ in the crank chamber 10' and the suction force $P_s'$ act on the swash plate from the piston via the shoe 52', and the action force exerted on the swash plate 34' reversely acts on the piston 44' via the shoe 52' as a reaction force which is equal in magnitude and oppositely directed to the action force. That is, when the piston 44' is in its suction stroke, the force F' exerted from the swash plate 34' on the piston 44' acts on the piston 44' at an angle perpendicular to surfaces of the swash plate 34' at a contact position Q' at which the semispherical outer surface of the shoe 52' remote from the body 46' of the piston 44' comes into contact with the semi-spherical inner surface of the shoe pocket 54', i.e., at an apex of the shoe pocket 54' lying on the central axis CA' of the piston 44'. The force F' exerted from the swash plate 34' on the piston 44' is composed of two components, horizontal and vertical, the horizontal component $F_x'$ lying on the central axis CA' of the piston 44' and the vertical component $F_y'$ being perpendicular to the central axis CA' of the piston 44'. Let "m" be the mass of the piston 44', "a" be the acceleration of the piston 44' during the suction stroke, "A" be the cross-sectional area of the piston 44', "θ" be the angle from horizontal the force F' is acting on the piston 44', and "d" be the diameter of the piston 44'.

$$\Sigma F_x' = -ma \tag{4}$$

$$\Sigma F_x' = AP_c' - AP_s' - F_x' \tag{5}$$

By combining the above equations, we can write, $$F_x=A(P_c'-P_s')+ma=ma+A(P_c-P_s')=ma+(\pi/4)*d^2(P_c'-P_s')$$

and $$F_y'=F_x' \tan\theta=\tan\theta[ma+(\pi/4)*d^2(P_c'-P_s')]$$

The vertical component $F_y'$ acts on the piston 44' as a bending moment. Let the depth of the piston 44' inserted into the cylinder bore 4' when the piston 44' reaches the maximum suction stroke position be W', and the length L' between the contact position, at which the outer surface of the shoe 52' remote from the piston body 46' comes into contact with the inner surface of the corresponding shoe pocket 54', and the rightmost front end of the piston 44'. Then, the maximum bending moment $M'_{max}$ acts on the piston at a position P' away by W' from the front end of the piston 44'. We can write this equation as $$M'_{max}=(L'-W')F_y'=(L'-W')\tan\theta[ma+(\pi/4)*d^2(P_c'-P_s')].$$

Since W' is generally short in an air conditioning compressor, the bending moment acting on the piston during the suction stroke also causes deformation and abnormal abrasion of the piston.

Figure 3:
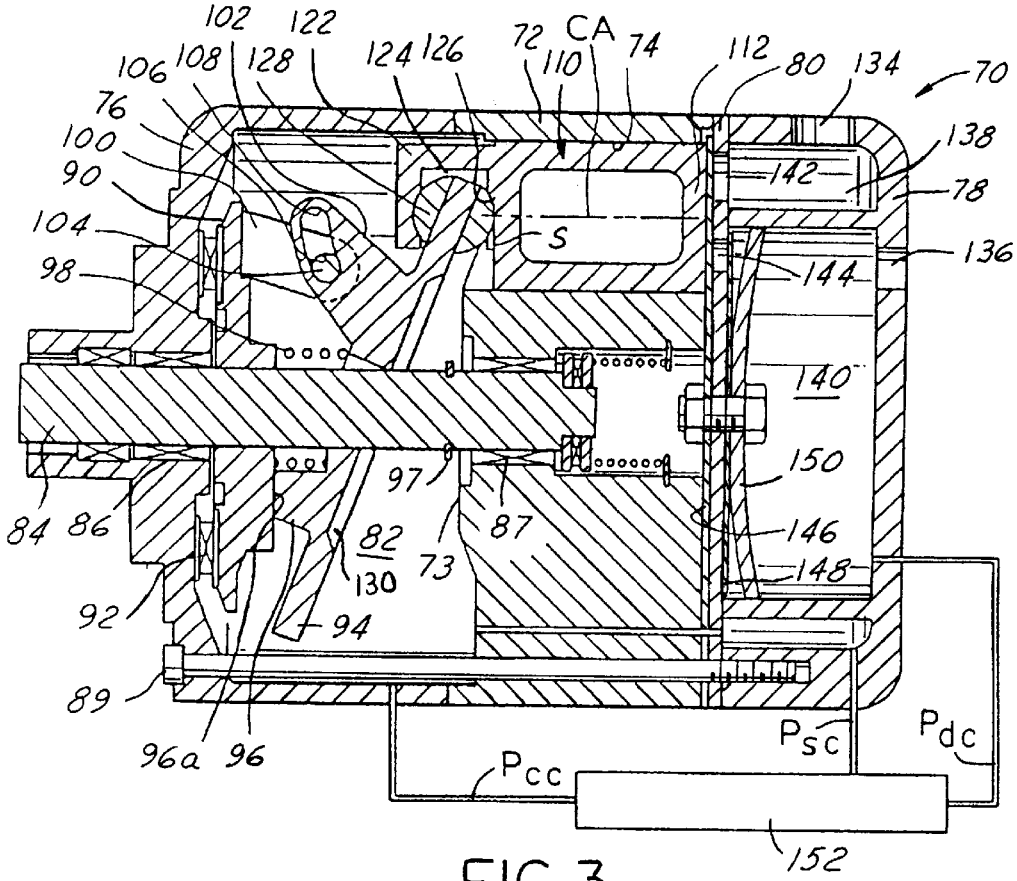
FIG. 3 is a sectional elevational view of a variable capacity swash plate type compressor with a piston and a mechanism to minimize a bending moment acting on a piston according to the present invention.

FIG. 3 shows a compressor, for example, a variable capacity swash plate type compressor having a mechanism for minimizing a bending moment. As shown in FIG. 3, a variable capacity swash plate type compressor 70 has a cylinder block 72 provided with a plurality of cylinder bores $^{74}$, a front housing 76 and a rear housing 78. Both front and rear ends of the cylinder block 72 are sealingly closed by the front and rear housings 76 and 78. A valve plate 80 is intervened between the cylinder block 72 and the rear housing 78. The cylinder block 72 and the front housing 76 define an air-tight sealed crank chamber 82. A drive shaft 84 is centrally arranged to extend through the front housing 76 to the cylinder block 72, and rotatably supported by radial bearings 86 and 87. The cylinder block 72 and the front and rear housings 76 and 78 are tightly combined by a long screw 89.

A rotor 90 is fixedly mounted on the drive shaft 84 within the crank chamber 82 to be rotatable with the drive shaft 84, and supported by a thrust bearing 92 seated on an inner end of the front housing 76. A swash plate 94 is rotatably supported on the drive shaft 84. If desired, a spherical sleeve (not illustrated) can be intervened between the drive shaft 84 and the swash plate 94. In this case, the swash plate 94 is rotatably supported on an outer support surface of the rotor 90. In FIG. 3, the swash plate 94 is in its largest inclination angle position, and at this time a spring 98 is most compressed and a stop surface 96a of a projection 96 comes into contact with the rotor 90 so that a further increase of inclination angle of the swash plate 94 is restricted by the rotor 90. On the other hand, a further decrease of inclination angle of the swash plate 94 is restricted by a stopper 97 provided with the drive shaft 84.

The swash plate 94 is connected to the rotor 90 via a hinge mechanism to be rotated with the rotor 90. That is, a support arm 100 protrudes axially outwardly from one side surface of the rotor 90, and an arm 102 protrudes from one side surface of the swash plate 94 toward the support arm 100 of the rotor 90. The support arm 100 and the arm 102 overlap each other and are connected to each other by a pin 104. The pin 102 extends into a pin hole 106 formed through the support arm 100 of the rotor 90 and a rectangular shaped hole 108 formed through the arm 102 of the swash plate 94. Support arm 100, arm 102 and pin 104 constitute a supporting and adjusting means. With this arrangement, the rotor 90 and the swash plate 94 are hinged to each other, and the sliding motion of the pin 104 within the rectangular hole 108 changes an inclination angle of the swash plate 94 so as to change the capacity of the compressor.

Figure 4:
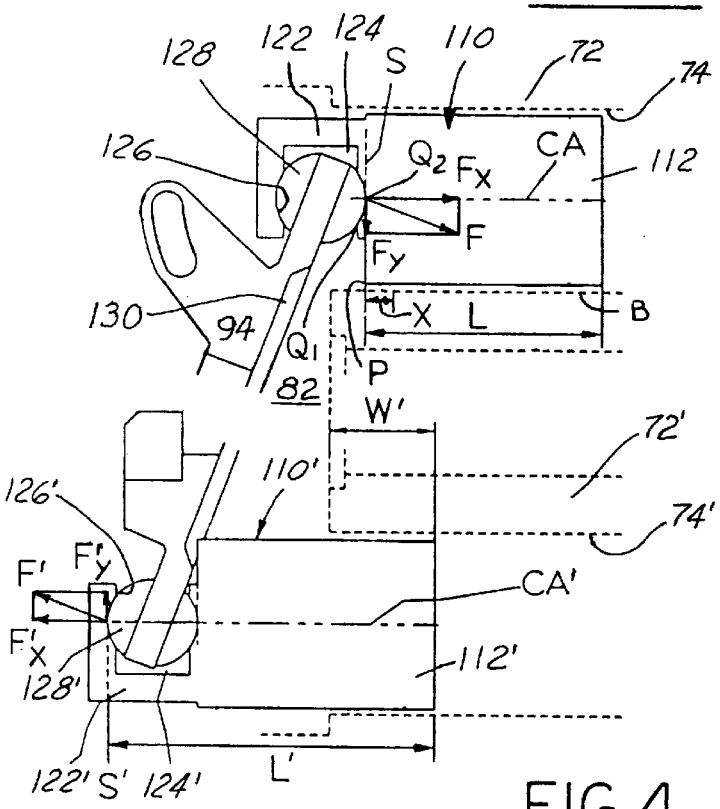
FIG. 4 is a fragmentary schematic view showing elements around the swash plate of FIG. 3 to illustrate the operation of the elements in the compressor.

As best illustrated in FIG. 4, each cylindrical piston 110 has a body 112 with a head and a bridge portion 122. The bridge portion 122 has a recess 124, and opposed walls defined in the recess 124 have spherical shoe pockets 126 into which spherical outer surfaces of two semi-spherical flat surfaces of the shoes 128 are slidably disposed. The inner flat surfaces of the shoes 128 are slidably engaged with side surfaces of the peripheral portion of the swash plate 94. With this arrangement, each piston 110 is engaged with the swash plate 94 via the shoes 128 and pockets 126, and therefore, the rotation of the swash plate 94 causes each piston 110 to reciprocate in the cylinder bore 74.

During the compression stroke of the piston 110, the force F exerted on the piston 110 from the swash plate 94 via the shoe 128 adjacent to the body 112 of the piston acts on the piston 110 at a right angle to a front surface of the swash plate 94 at a contact surface (in case of a line contact) or a contact point (in case of a point contact) (both will be referred as a contact position or an apex hereinafter) at which the semi-spherical outer surface of the shoe 128 adjacent to the body 112 comes into contact with the semi-spherical inner surface of the shoe pocket 126. The force F exerted from the swash plate 94 on the piston 110 is composed of two components, the horizontal component $F_x$ lying on the central axis CA of the piston 110 and the vertical component $F_y$ perpendicular to the central axis CA of the piston 110. The vertical component $F_y$ acts on the piston 110 as a bending moment.

To minimize the bending moment, a cutout portion is not formed in the body 112 of the piston 110. That is, in the construction of the piston in accordance with the present invention, the lower back edge P of the body 112 of the piston 110 lies on the line S which passes through the apex $Q_2$ of the shoe pocket 126 and is perpendicular to the central axis CA of the piston 110. Moreover, the lower back edge P of the piston body 112 is able to be further extended up to an entrance $Q_1$ of the shoe pocket 126 near the piston body 112. Therefore, the lower back edge portion is between the entrance $Q_1$ and apex $Q_2$ of the shoe pocket 126 near the piston body 112. As a result, the piston body 112 is compensated by the distance X compared to the piston body of prior art, and thus, the maximum bending moment acting on the piston does not occur from the above equation (3). The lower back portion P extends in a line through apex $Q_2$ and entrance $Q_1$ and continues to extend in perpendicular relation proximate to a line B defining an inner surface of the cylinder bore 74.

Figure 5:
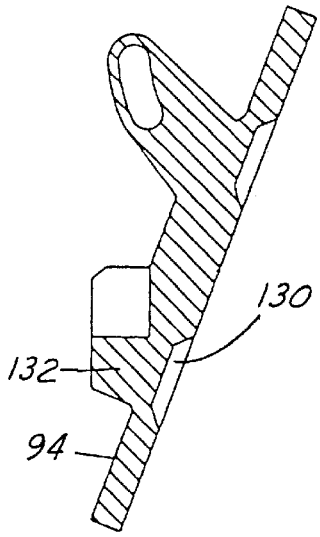
FIG. 5 is a sectional view of a second embodiment of swash plate according to the present invention adapted for use in a variable capacity swash plate type compressor of the type illustrated in FIGS. 3 and 4.

The interference between the swash plate 94 and the lower back edge portion of the piston body 112 due to compensation for the piston body 112 by the distance X can be solved by changing the shape of the swash plate 94. For example, as shown in FIGS. 3 to 5, the swash plate 94 has a depressed portion 130 formed in the side surface thereof confronting the piston body 112. The depressed portion 130 is positioned axially inward of shoe 128. The depressed portion 130 may be formed evenly in a central region of the swash plate 94 as shown in FIG. 3 and 4, or only in a region 130' in which the contact interference occurs as shown in FIG. 5. The depths of the depressed portions 130 and 130' are determined in response to the projection size of a center region of the cylinder block 72 as described hereinafter. Instead of the depressed portion 130, a thin swash plate or restriction on the smallest inclination angle of the swash plate can be employed to avoid the interference between the swash plate and the piston body.

It is advantageous to form a protuberant portion 132 opposed to the depressed portion 130' in response to the formation of the depressed portion 130' for reinforcing the swash plate as shown in FIG. 5.

Figure 6:
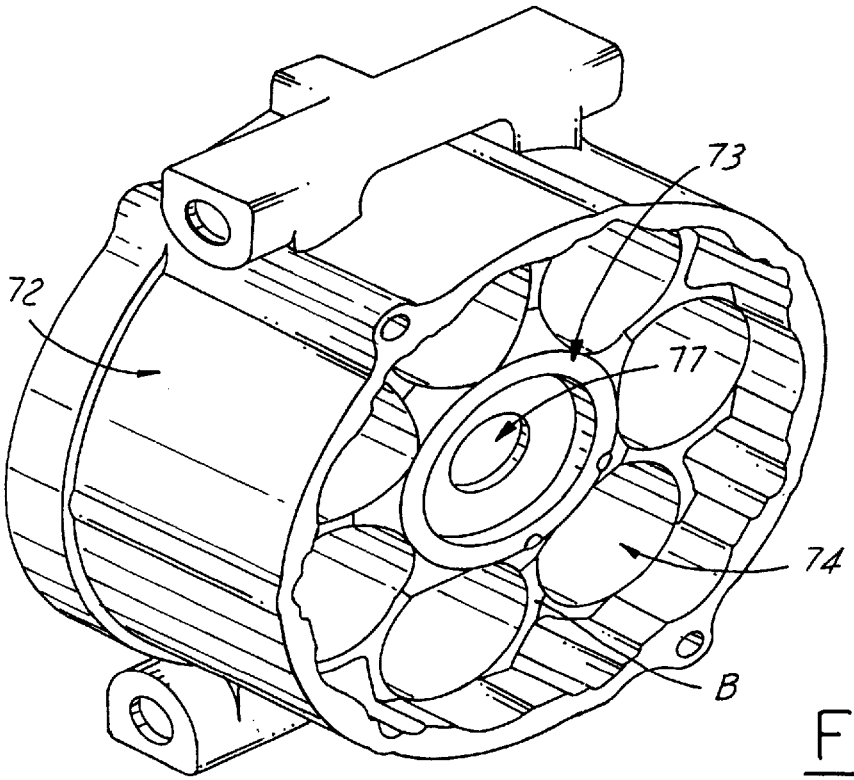
FIG. 6 is a perspective view of a cylinder block of the compressor according to a first embodiment of the present invention.

FIG. 6 shows a cylinder block for use in the compressor of the present invention. As shown in FIG. 6, the cylinder block 72 has an annular projecting portion 73 protruding from an entrance of each cylinder bore 74 as a reference surface B toward the depressed portion 130 of the swash plate 94. The projecting portion 73 is formed in a central region of the cylinder bore 72 between a central hole 77 for the drive shaft 84 and the cylinder bores 74. Instead of the annular shape of the projecting portion 73 formed around the cylinder bores 74 for reducing the mass of the compressor, the projecting portion 73 may be formed over the entire central region.

Figure 7:
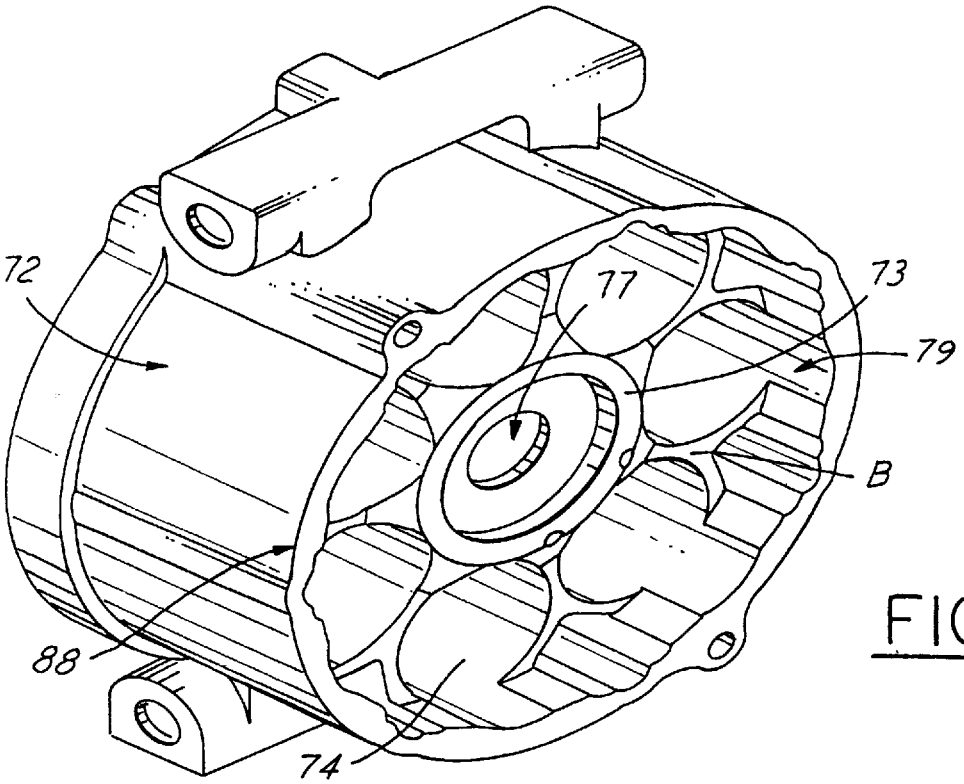
FIG. 7 is a perspective view of a cylinder block of the compressor according to a second embodiment of the present invention.

FIG. 7 shows another embodiment of the cylinder block in which a circumferential portion of the cylinder block 72 between the outer circumferential surface 88 and the cylinder bores 74 is extended from the cylinder block 72 in response to the projection of the inner projecting portion 73 so as to form an outer projecting portion 79. With this arrangement, the pistons are stably slid in their cylinder bores during the suction and compression strokes thereof.

The projecting portion 73 protrudes by the depth of the depressed portion 130 from the central region. Therefore, the insertion depth W' of the piston increases in response to the projection of the causes of the bending moment acting on the piston 110 during the suction stroke thereof to be reduced as seen from the equation (6).

The rear housing 78 is provided with inlet and outlet ports 134 and 136, and divided into suction and discharge chambers 138 and 140. The valve plate 80 has suction and discharge ports 142 and 144. Each cylinder bore 74 is communicated with the suction chamber 138 and the discharge chamber 140 via the suction ports 142 and the discharge ports 144. Each suction port 142 is opened and closed by a suction valve 146, and each discharge port 144 is opened and closed by a discharge valve 148, in response to the reciprocal movement of the respective pistons 110. The opening motion of the discharge valve 148 is restricted by a retainer 150.

A control valve means 152 is provided with the compressor 70 for adjusting a pressure level within the crank chamber 82 as shown in FIG. 3.

In the compressor having the above-described construction, when the drive shaft 84 is rotated, the swash plate 94 having a certain inclination angle is also rotated via the hinge mechanism, and thus, the rotation of the swash plate 94 is converted into the reciprocation of the pistons 110 within the respective cylinder bores 74 via the shoes 128. This reciprocating motion causes the refrigerant gas to be introduced from the suction chamber 138 of the rear housing 78 into the respective cylinder bores 74 in which the refrigerant gas is compressed by the reciprocating motion of the pistons 110. The compressed refrigerant gas is discharged from the respective cylinder bores 74 into the discharge chamber 140.

At this time, the capacity of the compressed refrigerant gas discharged from the cylinder bores 74 into the discharge chamber 140 is controlled by the control valve means 152 which adjustably changes the pressure level $P_{cc}$ within the crank chamber 82. Namely, when the pressure level $P_{sc}$ in the suction chamber 138 is raised with increase of the thermal load of an evaporator, the control valve means 152 cuts off the refrigerant gas at pressure level $P_{dc}$ traveling from the discharge chamber 140 into the crank chamber 82 so that the pressure level $P_{cc}$ in the crank chamber 82 is lowered. When the pressure level $P_{cc}$ in the crank chamber 82 is lowered, a back pressure acting on the respective pistons 110 is decreased, and therefore, the angle of inclination of the swash plate 94 is increased. Namely, the pin 104 of the hinge means is moved slidably and downwardly within the rectangular hole 108. Accordingly, the swash plate 94 is moved in a forward direction against the force of the spring 98. Therefore, the angle of inclination of the swash plate 94 is increased, and as a result, the stroke of the respective pistons 110 is increased.

On the contrary, when the pressure level $P_{sc}$ in the suction chamber 138 is lowered with decrease of the thermal load of the evaporator, the control valve means 152 passes the compressed refrigerant gas at pressure level $P_{dc}$ of the discharge chamber 140 into the crank chamber 82. When the pressure level $P_{cc}$ in the crank chamber 82 is raised, a back pressure acting on the respective piston 110 is increased, and therefore, the angle of inclination of the swash plate 94 is decreased. Namely, the pin 104 of the hinge means is moved slidably and upwardly within the rectangular hole 108. Accordingly, the swash plate 94 is moved in a rearward direction yielding to the force of the spring 98. Therefore, the inclination angle of the swash plate 94 is decreased, and as a result, the stroke of the respective pistons 110 is shortened and the discharge capacity is decreased.

In the above described compressor, during the compression stroke of the piston 110, the pressure $P_{cc}$ in the crank chamber 82 and the compression reaction force act on the piston 110. These forces act on the swash plate 94 via the shoes 122 and, in turn, reversely act on the piston 110 from the swash plate 94 as a reaction force equal in magnitude and oppositely directed. At this time, the maximum bending moment acts on the lower back edge portion P of the piston 110. However, the lower back edge portion P lies on the same line as the vertical component $F_y$ lies, and thus, the bending moment does not occurred on the lower back edge portion P of the piston 110 because the distance x is zero. As a result, deformation and abnormal abrasion of the pistons can be prevented.

On the other hand, during the suction stroke of the piston 110', the pressure in the crank chamber 82' acts on the piston, and this force acts on the swash plate 94' via the shoe 128' remote from the piston body 112' which, in turn, act on the piston from the swash plate 94' as a reaction force. At this time, the maximum bending moment acts on the piston at a contact surface between the outer surface of the piston 110' and the inner surface of the cylinder bore 74' when the piston 110' is inserted into the corresponding cylinder bore 74' by a certain depth. The central region of the cylinder block 72' is projected in response to the depth of the depressed portion 130' of the swash plate 94'. Thus, the insertion depth W' of the piston 110' into the cylinder bore 74' at the maximum suction stroke is increased so as to reduce the maximum bending moment acting on the piston 110'.

Although the present invention has been described in connection with the preferred embodiments, the invention is not limited thereto. It will be easily understood by those skilled in the art that variations and modifications can be easily made within the scope of the present invention as defined by the claims.

What is claimed is:

1. A variable capacity swash plate compressor, comprising:

a cylinder block having a plurality of cylinder bores arranged radially and circumferentially therein;

a housing mounted adjacent said cylinder block and cooperating with said cylinder block to define an air-tight sealed crank chamber;

a drive shaft rotatably supported by said housing and said cylinder block;

a rotor mounted on said drive shaft;

a swash plate connected to said rotor and slidably mounted on said drive shaft to thereby change an inclination angle thereof in response to changes of pressure in the crank chamber of said housing;

a supporting and adjusting means disposed between said rotor and said swash plate for changing the inclination angle of said swash plate;

a plurality of pistons reciprocatively disposed in each of the cylinder bores of said block, each piston having a cylindrical body and a bridge portion connected to the body and having a recess and a pair of shoe pockets formed in the recess;

a plurality of shoes disposed in the shoe pockets of the recess of each said piston to come into contact with said swash plate for converting rotation of said swash plate into reciprocation of said pistons;

a lower back edge portion is provided on the body of each said piston extending in a line through an apex and an entrance of the shoe pocket adjacent to the body and continuing to extend in perpendicular relationship proximate to a line defining an inner surface of the respective cylinder bore provided for each said piston; and wherein said swash plate is provided with a depressed portion located radially inward from said shoes such that contact between said swash plate and said lower back edge portion of each said piston is prevented.

2. The compressor according to claim 1, further comprising:

a control valve for adjusting the pressure level in the crank chamber of said housing.

3. A variable capacity swash plate compressor, comprising:

a cylinder block having a plurality of cylinder bores arranged radially and circumferentially therein;

a housing mounted adjacent said cylinder block and cooperating with said cylinder block to define an air-tight sealed crank chamber;

a drive shaft rotatably supported by said housing and said cylinder block;

a rotor mounted on said drive shaft;

a swash plate connected to said rotor and slidably mounted on said drive shaft to thereby change an inclination angle thereof in response to changes of pressure in the crank chamber of said housing;

a supporting and adjusting means disposed between said rotor and said swash plate for changing the inclination angle of said swash plate;

a plurality of pistons reciprocatively disposed in each of the cylinder bores of said block, each piston having a cylindrical body and a bridge portion connected to the body and having a recess and a pair of shoe pockets formed in the recess;

a plurality of shoes disposed in the shoe pockets of the recess of each said piston to come into contact with said swash plate for converting rotation of said swash plate into reciprocation of said pistons;

a lower back edge portion is provided on the body of each said piston extending in a line through an apex and an entrance of the shoe pocket adjacent to the body and continuing to extend in perpendicular relationship proximate to a line defining an inner surface of the respective cylinder bore provided for each said piston;

a depressed portion provided on said swash plate, said depressed portion being located radially inward from said shoes such that contact between said swash plate and said lower back edge portion of each said piston is prevented; and a projecting portion protruding from said cylinder block from an entrance of each cylinder bore toward said depressed portion of said swash plate and being between said drive shaft and the cylinder bores of said cylinder block.

4. The compressor of claim 3, wherein:

said cylinder block further includes an outer projecting portion protruding between the cylinder bores and an outer circumferential surface.

5. The compressor according to claim 3, further comprising:

a control valve for adjusting the pressure level in the crank chamber of said housing.

* * * * *